United States Patent [19]

Hall et al.

[11] Patent Number: 5,059,997

[45] Date of Patent: Oct. 22, 1991

[54] APPARATUS FOR PROCESSING PHOTOSENSITIVE MATERIAL

[75] Inventors: Douglas O. Hall, Canandaigua; Bruce R. Muller, Rochester, both of N.Y.

[73] Assignee: Eastman Kodak Company, Rochester, N.Y.

[21] Appl. No.: 630,142

[22] Filed: Dec. 17, 1990

[51] Int. Cl.[5] ..... G03D 3/06

[52] U.S. Cl. ..... 354/324; 354/322

[58] Field of Search ..... 354/317, 319, 320, 321, 354/322, 324; 134/64 P, 122 P

[56] References Cited

U.S. PATENT DOCUMENTS

| | | | |
|---|---|---|---|
| 3,192,846 | 7/1965 | Wright | 354/324 X |
| 3,641,911 | 2/1972 | Aelterman et al. | 354/324 X |
| 3,688,677 | 9/1972 | Frick et al. | 134/122 P |
| 3,988,756 | 10/1976 | Wick et al. | 354/319 |
| 4,758,857 | 7/1988 | Tanaka | 354/320 |
| 4,989,028 | 1/1991 | Hall et al. | 354/324 |
| 4,994,840 | 2/1991 | Hall et al. | 354/324 |

*Primary Examiner*—A. A. Mathews

*Attorney, Agent, or Firm*—G. Herman Childress

[57] ABSTRACT

Apparatus for processing photosensitive material includes upper and lower tanks for a processing solution. The tanks are connected together so that the solution can flow freely from the lower tank to the upper tank. The photosensitive material is advanced through a processing chamber between the tanks while the solution in the upper and lower tanks is provided to the chamber. A sump holds a supply of the processing solution, and a pump is coupled to the sump to draw the solution from the sump. The pump also is connected to the lower tank so that the processing solution is delivered to the lower tank, and from the lower tank some of the solution is furnished to the upper tank.

3 Claims, 3 Drawing Sheets

APPARATUS FOR PROCESSING PHOTOSENSITIVE MATERIAL

CROSS-REFERENCE TO A RELATED APPLICATION

Reference is made to commonly assigned, copending U.S. patent application Ser. No. 07/495, 671, entitled "Apparatus for Processing Photosensitive Material", filed Mar. 16, 1990 in the names of D. O. Hall and B. R. Muller, now U.S Pat. No. 4,994,840.

BACKGROUND OF THE INVENTION

This invention relates to apparatus for processing photosensitive materials, such as sheets of x-ray film.

The processing apparatus disclosed in the before-mentioned copending U.S. patent application includes an upper tank and a lower tank for holding a processing fluid. The tanks are located on opposite sides of a processing device, and fluid can flow from the tanks into a narrow processing chamber through which a sheet of photosensitive material is advanced for processing of latent images on the material. The processing fluid is delivered by a pump to fluid distributors in the upper tank. Fluid can flow from the upper tank to the lower tank.

It is known that aeration and air entrapment can cause degradation of the chemistry of a processing solution. Thus, it is desirable to reduce or eliminate the aeration or entrapment of air in such solutions. Air entrapment occurs any time the processing solution experiences a free-fall condition. In the apparatus disclosed in the before-mentioned application, aeration and air entrapment can occur because processing solution is delivered from the pump into the upper tank and it free-falls into the lower tank. Also, aeration of a processing solution is a function of the amount of fluid surface area exposed to air. Accordingly, if the surface area exposed to air can be reduced, the resulting aeration also is reduced.

Another concern is the cost of manufacture of a processing apparatus. Accordingly, it is desirable to eliminate portions of a processing apparatus whenever such can be accomplished without loss of reliability, quality or important features.

SUMMARY OF THE INVENTION

An object of the present invention is to eliminate a free-fall condition for fluid in a processor to reduce air entrapment and aeration of the fluid. Another object is to reduce the surface of a processing solution that is exposed to air in a processing apparatus, and thus the resulting air entrapment which degrades the chemistry of the solution. Another object of the invention is to eliminate certain structural features of the processing apparatus disclosed in the before-mentioned copending patent application without adversely affecting the operation of the apparatus.

The present invention relates to an improvement in an apparatus for processing photosensitive material wherein the apparatus has an upper tank for a processing solution and a lower tank for the processing solution. The tanks are coupled together so that processing solution can flow freely from the lower tank to the upper tank. A photosensitive material is advanced through a processing chamber between the upper and lower tanks, and processing solution is supplied from the upper tank and the lower tank to the processing chamber for developing latent images on the photosensitive material. A sump holds a supply of processing solution. The improvement comprises a pump that is coupled to the sump for receiving processing solution from the sump. The pump furnishes the fluid directly to the lower tank so that processing solution from the sump can be delivered by the pump to the lower tank with the solution then flowing upwardly into the upper tank.

BRIEF DESCRIPTION OF THE DRAWINGS

In the Detailed Description of the Preferred Embodiment of the invention presented below, reference is made to the accompanying drawings, in which.

DETAILED DESCRIPTION OF THE PREFERRED EMBODIMENT

In the following description, portions of the apparatus which are the same or similar to the processing apparatus of the before-mentioned U.S. application Ser. No. 495,671 will be described initially, followed by a description of the improvements of the present invention.

Figure 1:
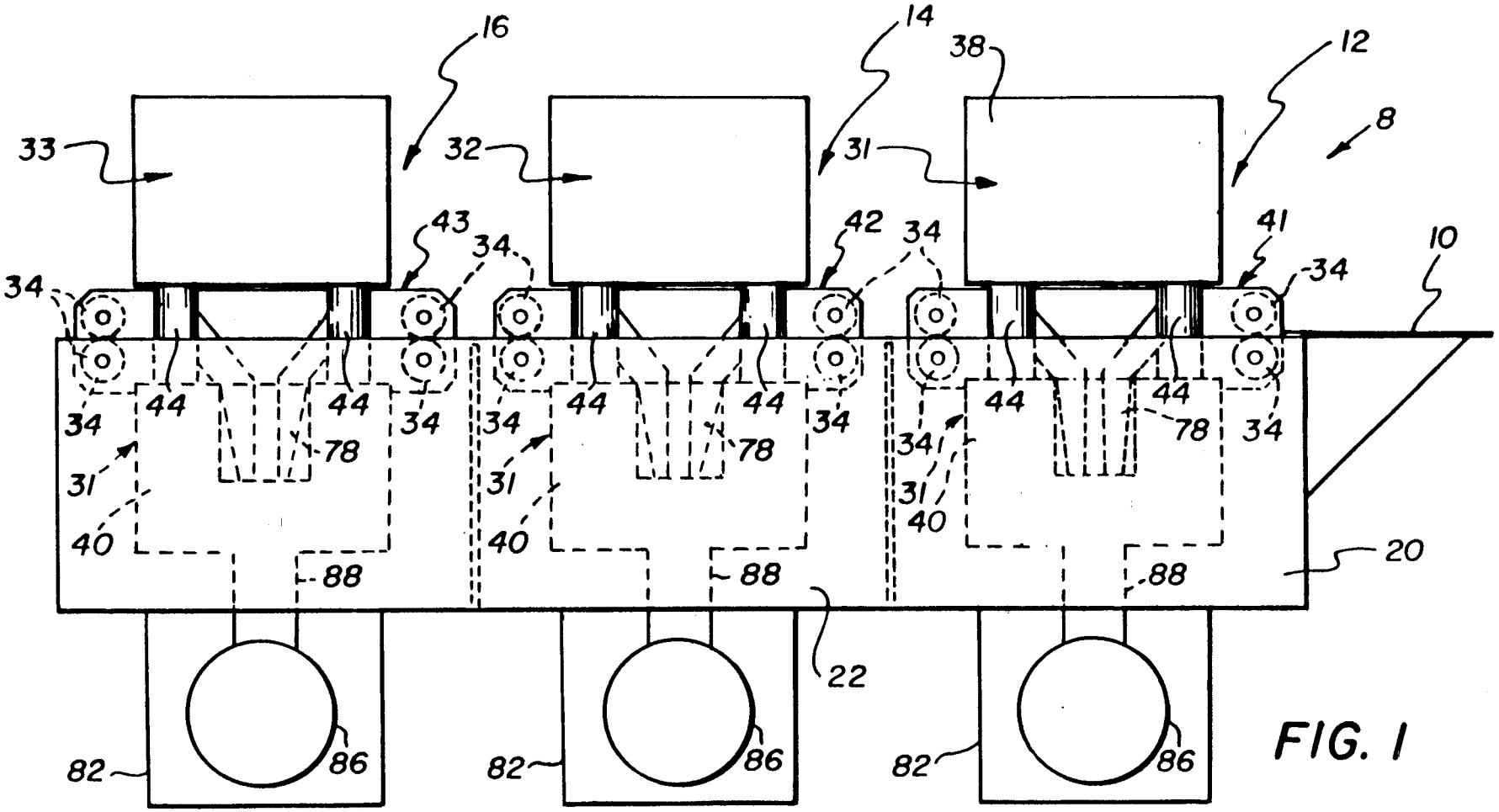
FIG. 1 is a side view of a photographic processing apparatus in accordance with the invention.
Figure 2:
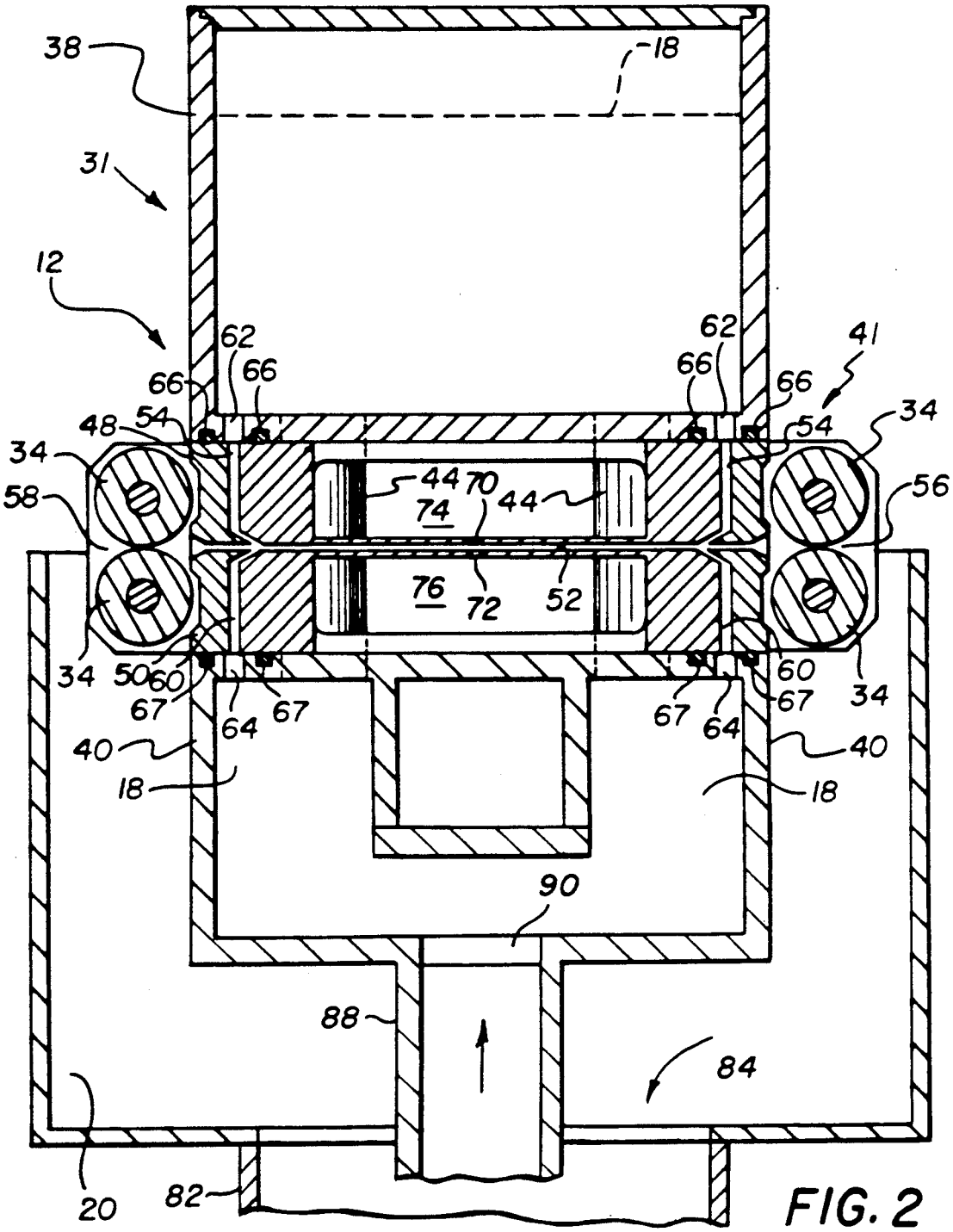
FIG. 2 is a cross section through one of the units of the processing apparatus.

FIGS. 1 and 2 of the drawings illustrate a photographic processing apparatus of the invention, generally designated 8, that is useful for processing a strip or sheet of photosensitive material 10 (film or paper). The photographic processing apparatus includes a plurality of photographic processing units, three of which are shown at 12, 14 and 16. A processing fluid 18 (FIG. 2) is supplied to each unit. The fluid 18 is generally in a liquid form including such photographic processing liquids as developer, fixer, bleach, rinsing fluid, water or any other fluids for use in the processing of photosensitive materials. Any number of photographic processing units can be included in the photographic processing apparatus depending on the number of processing fluids required for processing a specific photosensitive material.

A plurality of sump tanks 20, 22, 24 for fluid 18 are provided for units 12, 14, 16, respectively. The units 12, 14, 16 include vessels 31, 32, 33 respectively and processing devices 41, 42, 43, respectively.

The film 10 is conveyed through the apparatus by a plurality of pairs of nip rollers 34 of the photographic processing units 12, 14, 16. The rollers can be driven by any conventional drive means (not shown).

The photographic processing units 14, 16 are the same or similar in construction to the photographic processing unit 12. Therefore only processing unit 12 will be described in detail. Referring now to FIG. 2, vessel 31 comprises an upper tank 38 and a lower tank 40. Four connecting tubes 44 connect the interior of tanks 38 and 40. The tubes allow the fluid 18 to flow freely between the upper tank 38 and the lower tank 40.

A processing device 41 is located between the upper tank 38 and the lower tank 40. The device 41 includes a first or upper applicator housing 48 and a second or lower applicator housing 50. The housings define a fluid chamber 52, and film 10 travels through the chamber during processing of the film 10. Fluid 18 enters the chamber 52 through two elongated slots 54 in housing 48. The slots are located proximate an entrance end 56 and an exit end 58, respectively, of the fluid chamber 52. The fluid 18 also enters the chamber 52 through two elongated slots 60 in housing 50. The slots are located near the entrance and exit ends 56, 58 respectively of the fluid chamber 52. Thus an upper layer of fluid 18 and a lower layer of fluid 18 are formed on opposite sides of the film 10 in chamber 52.

The upper tank 38 has slits 62 in the lower wall which are aligned with the inlet slots 54 in housing 48. Also, the lower tank 40 has slits 64 formed in its upper wall which are aligned with the inlet slots 60 in housing 50. The slits 62 permit fluid 18 to flow between the upper tank 38 and the chamber 52, and the slit 64 allows fluid to flow between the lower tank 40 and the chamber 52. Accordingly, the processing device 41 is essentially submersed in the fluid 18 in the vessel 31. O-rings 66, 67 seal the interface between the tanks 38, 40 and the applicator housings 48 and 50.

Figure 3:
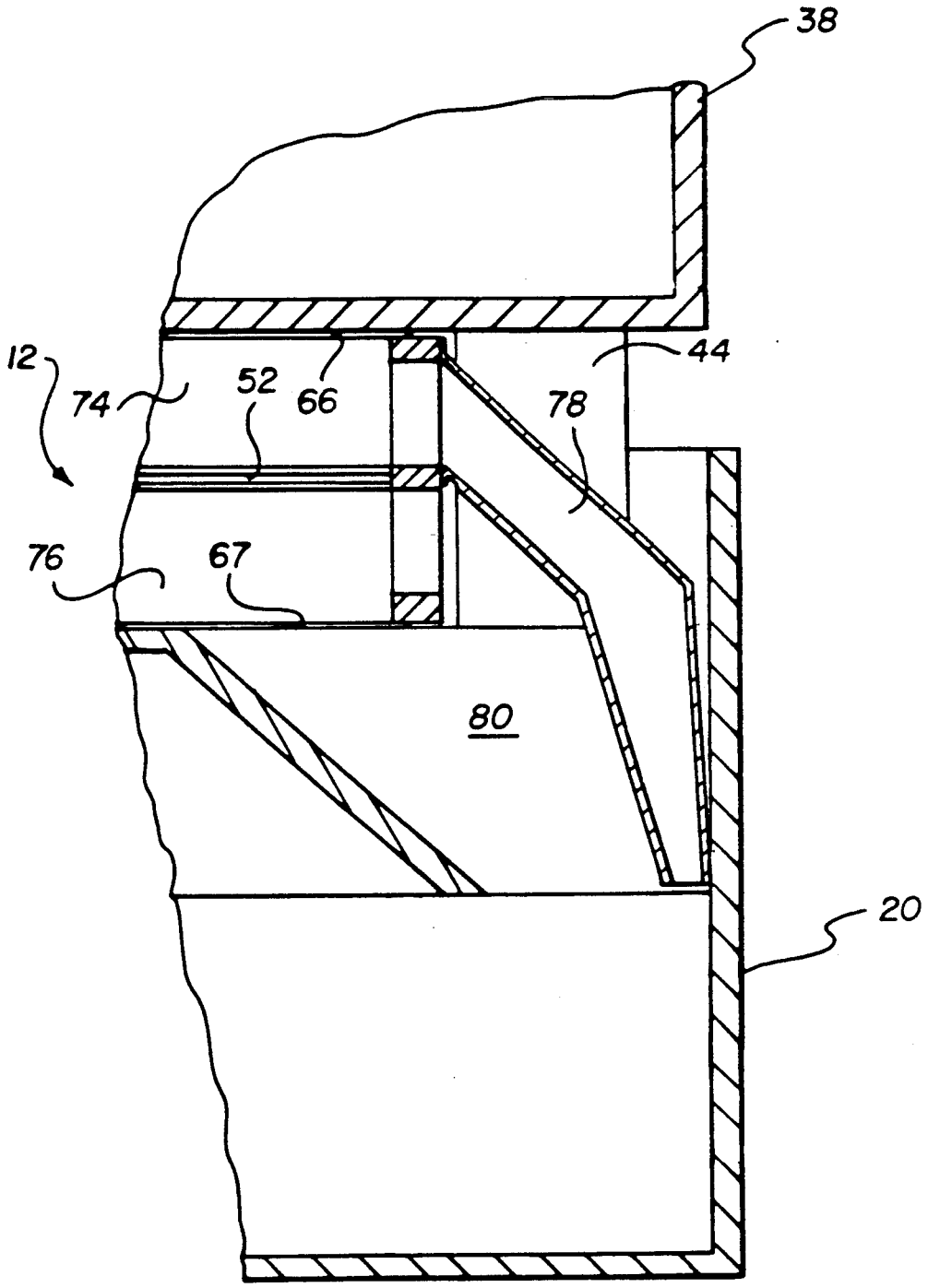
FIG. 3 is a fragmentary section showing the path for processing solution from the processing chamber to the sump.

Processing fluid furnished to chamber 52 flows toward the center of the processing device 41 and along both surfaces of the photosensitive material 10. The fluid is exhausted from chamber 52 through slit-shaped orifices 70, 72 that lead into upper and lower drains 74, 76, respectively. The processing fluid flows from drains 74, 76 through chutes 78, 80, respectively, and then back into the sump 20, as shown in FIG. 3.

The portions of the processing apparatus described hereinbefore are disclosed in more detail in the before-mentioned, commonly-assigned copending U.S. Pat. application Ser. No. 495,671. In that application, processing fluid returned through chutes 78, 80 to the sump 20 is recirculated to the upper tank 38 for reuse in processing the photosensitive medium 10. This is accomplished in that application by providing conduits in the sump 20 that are connected to the suction or inlet of a pump located in the sump, and connecting the outlet of the pump to a series of conduits located in the upper tank 38. These conduits in the sump 20 and the upper tank 38 have been eliminated in accordance with the present invention, along with a reduction in the fluid surface exposed to air and the resulting inherent air entrapment that results therefrom.

In accordance with the present invention, sump 20 includes an extension 82 at the bottom of the sump, and an opening 84 (FIG. 2) in the sump enables processing fluid to flow from the upper portion of the sump into the extension 82. A pump 86 is located in the extension 82 and has an inlet or suction side through which fluid can enter the pump from the extension 82. The outlet of the pump is connected by a conduit 88 directly to the bottom of the lower tank 40 through an opening 90 in the lower tank. Thus, operation of the pump 86 withdraws processing fluid from the extension 82 of the sump and forces it upwardly through conduit 88 and opening 90 directly into the bottom of the lower tank 40. The processing fluid flows upwardly through the connecting tubes 44 into the upper tank 38 until the fluid in the upper tank reaches the desired level. Delivery of the processing fluid in this manner avoids a free-fall condition that causes aeration and air entrapment in the fluid.

With the fluid thus supplied to both the upper tank and the lower tank, the photosensitive material 10 can then be processed by the fluid flowing from both the upper tank and the lower tank into the chamber 52 through the slits 62, 64 and through the inlet slots 54 and 60. The fluid leaves chamber 52 through orifices 70, 72 and then travels through drains 74, 76 and chutes 78, 80 back to the sump 20 and the sump extension 82.

While the drawings show the pump located in the sump, it could be located outside the sump, if desired, and be connected to the sump and lower tank by suitable conduits.

A number of advantages are achieved by the present invention. As noted before, both aeration and air entrapment cause degradation of the chemistry of the processing fluid 18. Aeration and air entrapment are avoided by furnishing the fluid 18 to the bottom of tank 40 only and allowing it to flow upwardly through tubes 44 to the upper tank 38, instead of delivering the fluid directly from the sump to the upper tank. Thus, the free fall condition occurring in the prior apparatus disclosed in the before-mentioned patent application, and resulting from the flow of fluid through tubes 44 from the upper tank to the lower tank, has been eliminated. Another advantage of the apparatus of the invention is that the supplying of fluid to the bottom tank 40, instead of the upper tank 38, reduces the amount of fluid surface area exposed to the air and thus reduces the amount of aeration. Also, the cost of the apparatus of this invention is less than the cost of the apparatus disclosed in the prior U.S. application Ser. No. 485,671, because the fluid distributors in tanks 20 and 38 in the prior apparatus have been eliminated.

The invention has been described in detail with particular reference to a preferred embodiment thereof, but it will be understood that variations and modifications can be effected within the spirit and scope of the invention.

We claim:

1. In apparatus for processing photosensitive material, the apparatus having an upper tank for a processing fluid and a lower tank for the processing fluid, means coupling the tanks together so that processing fluid can flow freely from the lower tank to the upper tank, a processing chamber between the upper and lower tanks through which the material can be advanced for processing the material, means for supplying processing fluid from the upper tank to the processing chamber and from the lower tank to the processing chamber, and a sump for holding a supply of processing fluid; the improvement comprising:

a pump having an inlet in fluid communication with the sump for receiving processing fluid from the sump and having an outlet connected directly to the lower tank so that processing fluid from the sump is delivered by the pump to the lower tank with the fluid then flowing upwardly into the upper tank through the means coupling the tanks together, thus reducing aeration and air entrapment by avoiding a free-falling condition in the fluid.

2. In apparatus for processing photosensitive material, the apparatus having an upper tank for a processing fluid and a lower tank for the processing fluid, means coupling the tanks together so that processing fluid can flow freely from the lower tank to the upper tank, a processing chamber between the upper and lower tanks through which the material can be advanced for processing the material, means for supplying processing fluid from the upper tank to the processing chamber and from the lower tank to the processing chamber, and a sump for holding a supply of processing fluid; the improvement comprising:

a pump in fluid communication with the sump for receiving processing fluid from the sump, and a conduit connecting the pump directly to the lower tank so that processing fluid from the sump is delivered by the pump to the lower tank with the fluid then flowing upwardly into the upper tank through the means coupling the tanks together, thus reducing aeration and air entrapment by avoiding a free-falling condition in the fluid as it flows from the pump into the lower and upper tanks.

3. Apparatus as set forth in claim 2, wherein the pump is located in the sump, and the conduit is connected to the bottom of the lower tank.

* * * * *